US006196312B1

(12) United States Patent
Collins et al.

(10) Patent No.: US 6,196,312 B1
(45) Date of Patent: Mar. 6, 2001

(54) DUAL PUMP GRAVITY SEPARATION SYSTEM

(75) Inventors: Rodney Douglas Grey Collins, Red Deer; Gordon James McIntosh, Fort St. John, both of (CA)

(73) Assignees: Quinn's Oilfield Supply Ltd.; Petro-Canada Oil and Gas, both of Alberta (CA)

( * ) Notice: Subject to any disclaimer, the term of this patent is extended or adjusted under 35 U.S.C. 154(b) by 0 days.

(21) Appl. No.: 09/066,855

(22) Filed: Apr. 28, 1998

(51) Int. Cl.[7] ..... E21B 43/40
(52) U.S. Cl. ..... 166/265; 166/106; 166/306
(58) Field of Search ..... 166/265, 313, 166/106, 105, 105.5, 306

(56) References Cited

U.S. PATENT DOCUMENTS

| | | | | |
|---|---|---|---|---|
| 2,281,801 | | 5/1942 | Reynolds et al. . | |
| 4,241,787 | | 12/1980 | Price . | |
| 4,296,810 | | 10/1981 | Price . | |
| 4,766,957 | | 8/1988 | McIntyre . | |
| 4,793,408 | | 12/1988 | Miffre . | |
| 4,805,697 | | 2/1989 | Fouillout et al. . | |
| 4,880,062 | * | 11/1989 | Bland et al. | 166/371 |
| 5,048,604 | | 9/1991 | Vadasz et al. . | |
| 5,176,216 | * | 1/1993 | Slater et al. | 166/105.5 |
| 5,296,153 | * | 3/1994 | Peachy | 210/787 |
| 5,335,732 | | 8/1994 | McIntyre . | |
| 5,374,163 | | 12/1994 | Jaikaran . | |
| 5,443,120 | | 8/1995 | Howell . | |
| 5,497,832 | | 3/1996 | Stuebinger et al. . | |
| 5,509,479 | | 4/1996 | Emmons . | |
| 5,579,838 | | 12/1996 | Michael . | |
| 5,697,448 | * | 12/1997 | Johnson | 166/369 |

FOREIGN PATENT DOCUMENTS

| | | |
|---|---|---|
| 2152070 | 12/1993 | (CA) . |
| 2172820 | 9/1994 | (CA) . |
| 2167277 | 1/1995 | (CA) . |
| 2155704 | 8/1995 | (CA) . |
| 2194572 | 8/1987 | (GB) . |
| 2248462 | 4/1992 | (GB) . |

* cited by examiner

*Primary Examiner*—David Bagnell
*Assistant Examiner*—Zakiya Walker

(57) ABSTRACT

A system of reciprocating bottom hole sucker rod pumps, situated in an oil well, to produce an oil rich stream to surface and inject a water stream to a same wellbore disposal zone. Two pumps vertically in tandem are actuated by a single sucker rod string. Separate intakes for each pump are situated so as to allow for gravity to segregate oil and water in the wellbore before reaching the intakes. Both streams are produced out of the pumps on the upstroke. Injection of the water stream is facilitated by an outer housing around the bottom pump to redirect flow to a disposal zone.

5 Claims, 4 Drawing Sheets

DUAL PUMP GRAVITY SEPARATION SYSTEM

BACKGROUND OF THE INVENTION

1. The Field of the Invention

The invention relates to the separation of oil and water due to gravity in a subterranean petroleum production well. In particular, the present invention concerns the production of the oil to surface, and the disposal of the water to a zone in the same wellbore, using a reciprocating sucker rod pumping system.

2. The Prior Art

Typically, oil wells produce a significant amount water. Water can often be as high as 99+% of total production. Traditionally, all water has been brought to the surface along with the oil. The oil and the water has been separated at surface by a variety of means and then disposed of in a variety of manners. This process has extensive costs associated with it. It takes big equipment and lots of power to lift to surface the large amounts of fluid required to retrieve a small proportion of oil. There are then costs associated with separating the oil from the water at surface, handling the then pure (i.e. no oil), but still possibly corrosive water, and disposing of it in a dedicated disposal well or by other means. The concept of "water control" to reduce operating costs and increase hydrocarbon production is receiving greater and greater attention in these competitive economic and environmentally conscious times.

One approach that has been taken to reduce these lifting and handling costs is to separate and dispose of the water downhole in the same wellbore. Most inventions facilitate the actual separation of the oil from water by a variety of mechanisms and apparatus. These include the use of filter systems, cyclones, and built in chambers where the oil is allowed to separate from the water by the force of gravity. U.S. Pat. No. 4,766,957 even describes under reaming a section of wellbore for water accumulation. Any actual apparatus that is required to facilitate oil/water segregation complicates the overall production system, and as a person familiar in the art will understand, should be avoided whenever possible.

Most downhole separation processes are driven by some form of surface or subsurface pump and/or include a control mechanism. Many of these separation and disposal processes are directed toward the deliquification of gas wells and/or toward flowing oil wells where there is enough reservoir energy to bring the desired hydrocarbons to surface such that no artificial lift system is necessary. However, a large proportion of the world's producing oil wells do not flow on their own and some form of artificial lift is required.

Most inventions are dedicated to disposing of water into a zone below the actual hydrocarbon producing zone. Unfortunately, many producing petroleum wells do not have an acceptable disposal zone below the production zone but do have one above the production zone. U.S. Pat. No. 5,579,838 specifically describes a method of disposing above the production zone. Again however, although not specifically stated, this process must be directed at gas wells and flowing oil wells as there is no provision for artificially lifting fluids to surface.

As already stated, most inventions facilitate the actual separation of the oil from water by a variety of mechanisms and apparatus. It is possible however to allow the force of gravity to segregate the oil from the water while it is still in the wellbore. The additional challenge however, is to artificially lift the desired hydrocarbons to surface, while disposing of the water to a zone in the same wellbore. Two inventions are noted.

UK Patent Application GB 2,248,462 describes the use of a progressive cavity pump (PCP) form of artificial lift. There are basically two PCP's connected together at the rotors. The rotor and stator combinations are configured in such a way that the upper set pumps oil up to surface and the lower set pumps water down to a disposal zone. Although incredibly simple and effective there are some inherent disadvantages to using a PCP in this application. Historically, PCP's have had specific limitations over other common forms of oil well artificial lift (i.e. reciprocating sucker rod pumps and electric submersible pumps). Firstly, because of the required use of an elastomer stator, the serviceability in a pure water application and/or in light oils containing aromatics is severely restricted. Secondly, PCP's have limited pressure capabilities which restrict their use in deeper wells and more specifically, in a separation/disposal application, restrict their use in wells where the disposal zone might have a high reservoir pressure or low infectivity. Thirdly, to get the fluid to warrant the inherently high service and repair costs, most PCP are still in a "tubing pump" configuration. That is, the entire pump needs to be run and retrieved on tubing, which to someone familiar in the art, will understand is a distinct disadvantage when compared to a reciprocating sucker rod pump, the embodiment of the current invention, which can be run and retrieved with the sucker rod string alone and does not require the "pulling" of both the rods and then the tubing. Finally, and most importantly with respect to wellbore gravity separation, a PCP is a constant flow pump and allows no "dead time" for additional gravity segregation of the oil and the water. A reciprocating rod pump on the other hand, only produces fluid on the upstroke. This means that half of the operating time (the downstroke) is "dead", allowing for even better gravity separation in the wellbore.

U.S. Pat. No. 5,497,832 describes a method of oil/water wellbore gravity separation and same wellbore water disposal using a reciprocation rod pump system. The Dual Action Pumping (DAP) system as described overcomes many of the limitations of the PCP pump above. However, the DAP does have some distinct disadvantages of its own. Firstly, the DAP is configured as a tubing pump, which means the whole system has to be run and retrieved on tubing as with the PCP. Secondly, the DAP as described in the patent requires the use of several conventional ball and seat valving systems that are attached external to the regular smooth profile of the "tubing pump". A person familiar in the art will understand that this will severely reduce the ruggedness of any downhole tool. This condition could easily result in actual physical damage when running or retrieving the system. Thirdly, and most importantly, the DAP injects the disposal water on the downstroke. Since there will always be a resistance to flow, due both to reservoir formation pressure and to the limited permeability of the formation, the DAP is required to create a downward force on the downstroke. This is not a typical condition for sucker rod pumping where all the load is taken on the upstroke. Again, a person familiar in the art will understand that, with an opposing upward force on the downstroke, the sucker rods in the well bore will tend to buckle, reducing bottom hole pump stroke and leading to a myriad of other potential mechanical problems in the production system. Although special sucker rod string design can effectively overcome small upward forces on the downstroke, the solutions will become impractical at higher disposal zone reservoir pressures and low permeabilities. Finally, the DAP patent does not suggest that the system can be utilized with an above production disposal zone.

As can be seen, although prior art has utilized wellbore gravity separation and linked it with common methods of artificial lift, there is still a need to overcome limitations in serviceability, ruggedness, rod loading, and disposal zone location.

SUMMARY OF THE INVENTION

The present invention provides an economic means of producing an oil rich stream of fluid to surface using a reciprocating sucker rod pumping system while eliminating all of the limitations of the prior art in this area. Oil and water are allowed to segregate in the wellbore due to the forces of gravity thus eliminating the need for any actual separation apparatus. The present invention utilizes conventional reciprocating sucker rod pumping techniques alleviating the limitations and disadvantages of electric submersible and progressive cavity pumping systems. Two pumps are utilized to provide for artificial lift to surface of the desirable hydrocarbons in a case where reservoir energy alone is not sufficient to produce the well. The undesirable water is disposed of in the same wellbore, usually below a packer and into a below production injection zone. The system can however be adapted for an above production disposal zone. The two pumps are configured vertically in tandem with the plungers connected to each other. The pump is then actuated by a single sucker rod string. Separate intakes for each pump are situated so as to allow for gravity to segregate oil and water in the wellbore before reaching the intakes. Both streams are produced out of the pumps on the upstroke. Injection of the water stream is facilitated by a streamlined outer housing around the bottom pump to redirect flow to the disposal zone. This allows for acceptable rod loading in the classic sucker rod pumping manner. The upper pump is of an "insert" design to allow for easy retrieval with a sucker rod string. The upper insert pump hold down and seating nipple are especially designed to allow for flow intake to the top pump while maintaining hydraulic isolation from the bottom pump. There are no protuberances on the outside of the system to cause difficulties during wellsite operations.

DESCRIPTION OF THE INVENTION

The following description details the various components and preferred embodiment of the Dual Pump Gravity Separation (DPGS) system of the present invention.

Figure 1:
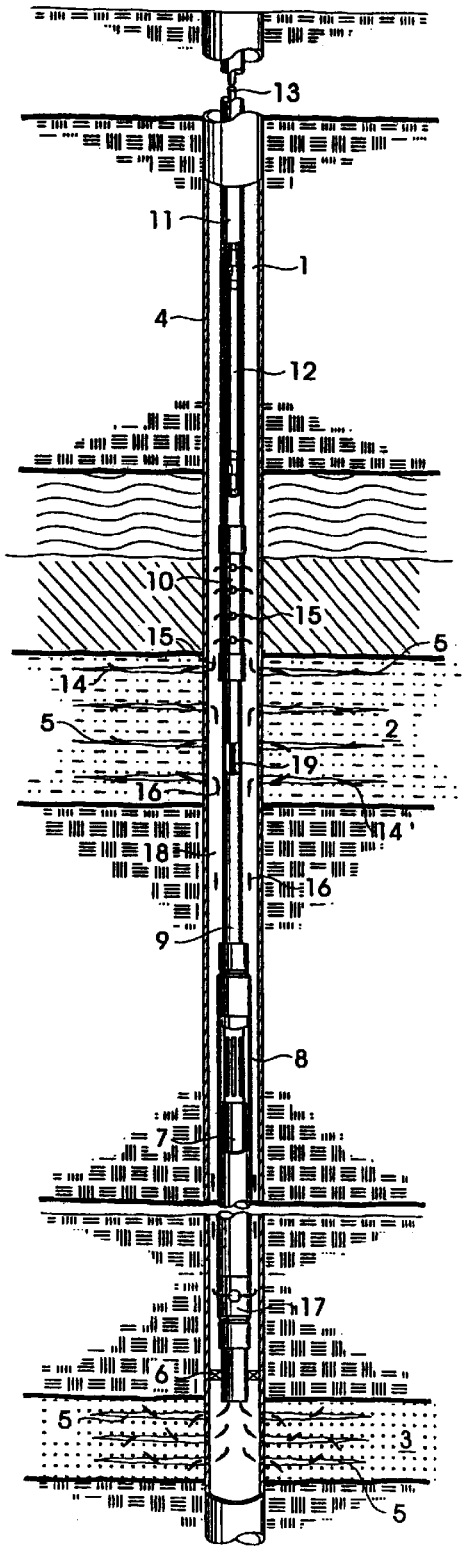
FIG. 1 is a schematic side elevation view, partially in section, of a wellbore of a production well in which the preferred embodiment of the dual pump gravity separation system of the present invention is installed.

Referring to FIG. 1, a subterranean well bore 1 traverses first a hydrocarbon producing formation 2 and then extends downwardly a distance to traverse a water disposal formation 3. A casing string 4 is run into the well in traditional fashion. Perforations 5 are effected through the casing 4 and into each of the two formations 2,3 in traditional fashion. A production packer 6 is preferably disposed immediately adjacent the top of the disposal formation. A conventional tubing pump 7 and outer housing 8 is attached to, and immediately above, the said packer 6. Production tubing 9 extends upwardly from the tubing pump 7 and outer housing 8 to a cross drilled seating nipple 10 attached to production tubing above 11 and below 9 in a traditional manner. A bottom hole pump 12 of conventional insert configuration is landed in the cross-drilled seating nipple 10 in traditional fashion. Both the top insert pump 12 and the bottom tubing pump 7 are actuated with a sucker rod string 13 in traditional fashion.

Still referring to FIG. 1, production fluid 14 enters the wellbore 1 through perforations 5 in the production zone 2. While the two pumps are producing, some fluid 15 flows up to the cross-drilled seating nipple 10 which is the intake for the top insert pump 12, but the majority of the fluid 16 flows down toward the bottom intake/discharge adapter 17 which is the intake for the bottom tubing pump 7. The amount of flow to each pump is defined by the proportional bore diameter of each pump to the other.

As the production fluid flows down the wellbore 1 toward the bottom intake/discharge adapter 17 it enters the annular area 18 between the casing 4 and the lower production tubing 9. The lower production tubing 9 is to be as small as possible and still allow for sucker rods 19 on the inside to actuate the bottom tubing pump 7. The lower production tubing 9 is also to be as long as possible, defined by the disposition of the production zone 2 and the disposal zone 3 and the placement of the perforations 5 and production packer 6.

As production fluid 14 enters the wellbore 1 it has already been partially separated into oil and water in the formation 2. This occurs due to the fact that the density of oil is less than water and the effects of gravity will tend to segregate the oil toward the top of the formation 2. Also, it has been observed by downhole video that oil tends to enter the wellbore as large droplets or even a stream. From this it is then assumed that the emulsification of the oil and water as traditionally seen at surface is actually merely a result of the turbulence created in the fluid as it is produced through a conventional pump and up the production tubing. The present invention utilizes this phenomenon of oil/water gravity separation in the formation and in the wellbore to produce an oil rich stream 15 to surface while disposing of the majority of the water 16 to a same wellbore disposal zone 3.

People skilled in the art will understand that in most conventional instances it is necessary to produce water out of the production zone to get any hydrocarbon at all. This is due to the fact that water moves more easily through reservoir rock than oil does, the mobility ratio.

Given definable individual reservoir properties it is possible to closely estimate how much water is required to be produced to produce a given amount of oil. The sizing of the two pumps of the present invention is determined from this. The top insert pump 12 is sized to produce all the expected oil and only a small portion of the total water. The lower tubing pump 7 is sized to produced the remaining water as determined by desired oil production. The reason the top insert pump 12 is sized to produce at least some water is to partially ensure that no hydrocarbons are injected with the water to the disposal zone 3. Hydrocarbon injection to the disposal zone 3 will over time decrease the injectivity of the zone and eventually plug it off completely.

Figure 6:
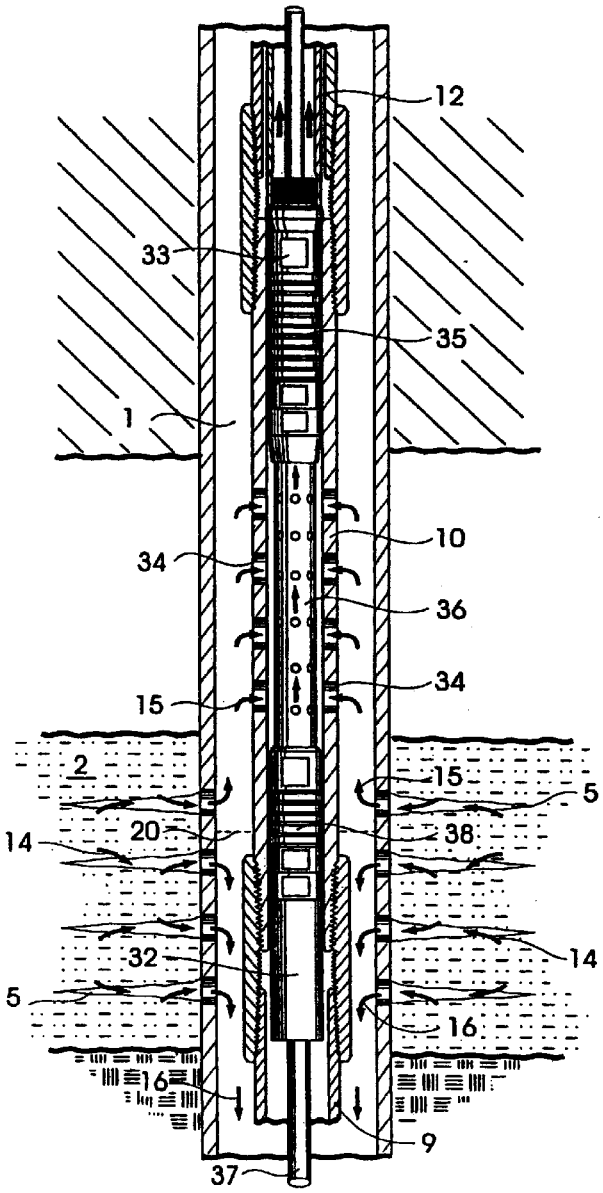
FIG. 6 is a side elevation view, partially in section, of the cross-drilled seating nipple, dual hold-down, and the oil rich side of the dual pump gravity separation system of the present invention.

FIG. 6 depicts the cross-drilled seating nipple 10 that is the intake to the top insert pump 12. Now, referring to FIG. 6, it can be described in closer detail what is occurring as production fluid 14 flows into the wellbore 1 through the perforations 5. As discussed, due to the relative sizing of the two pumps, only a small portion of production fluid 15 is drawn into the top insert pump 12. Also as discussed, due to the effects of oil/water gravity separation in the producing formation 2, the production fluid 15 drawn into the top insert pump 12 will be oil rich. Now, again due to, and depending on, the relative sizing of the two pumps, an area of zero velocity flow 20 (represented by dotted line) will be present in the wellbore 1 somewhere (usually towards the top) along the perforations 5 of the production zone 2. This zero velocity area will occur at a point where all the fluid above it is flowing upward to the intake of the top insert pump 12, and all the fluid below it is flowing downward to the intake of the bottom tubing pump.

Another phenomenon that enhances oil/water separation in the formation 2 and in the well bore 1, is "water coning". As discussed, water has greater mobility through the reservoir than oil. In a conventional production scenario, near the wellbore, this could result in the water actually "sweeping aside" the oil and producing less oil, or even no oil at all, to the wellbore 1, even though there is still producible oil in the formation 2. In the embodiment of the present invention, a large portion of the total production fluid 16 enters the wellbore 1 and then flows down toward the bottom tubing pump. The water coning effect would still be present but now in a "reverse" manner. Water would still be "sweeping" through the reservoir but because the majority of flow is downward instead of upward the sweeping effect may tend not to block off oil production through the top portion of the production zone 2 to the wellbore 1. Now, with the top insert pump 12 still providing a small amount of upward flow 15, and with the "reverse coning" effect caused by the bottom tubing pump, oil/water gravity separation may be enhanced and overall oil production may actually increase.

Now, ideally, assuming reservoir characterization and pump sizing is correct, all the oil that is produced will enter the wellbore 1 above the zero velocity area 20. However, due to the dynamics of the reservoir, some of the producible oil will actually enter the wellbore 1 as an emulsion with, and/or as small droplets entrained in, the water 16. As discussed, this is not a desirable situation as this oil would be produced with the water 16 and injected into the disposal zone, eventually plugging off the disposal zone.

Now, emulsified/entrained oil enters the wellbore with the water (below the zero velocity area) and starts moving downward. The force of gravity will continue to tend to separate the oil from the water, however, the force of gravity now also has to contend with the shear force between the oil droplets and the water as the combined fluid flows downward at any given velocity. If the velocity is high enough, shear forces will be more than gravitational forces and no separation and upward movement of the oil will occur.

Referring back to FIG. 1, as water with emulsified/entrained oil moves down toward the intake 17 to the bottom tubing pump 7, it enters the annular area 18 between the casing 4 and the lower production tubing 9. This annular area 18, with as small as possible production tubing 9, is designed to provide an area of large volume that the water has to flow through before reaching the intake 17 to the bottom tubing pump 7. By creating this large volume, the downward velocity of the fluid is reduced. Not only does this reduce the downward shear forces of the water on the oil but it also provides more "residence time" for the emulsion or small droplets to combine together into larger droplets before reaching the bottom tubing pump intake. Since the force of gravity is proportional to the volume ($\frac{1}{6}\pi D^3$) of the oil droplet and the shear force is proportional to surface area ($\pi D^2$), increasing droplet size will create a larger gravitational effect than a shear effect. This will lead to a net upward movement of the oil that was originally emulsified/entrained in the water 16 that entered the well bore 1 and began flowing down to the intake 17 of the bottom tubing pump 7.

With respect to this "residence time" phenomenon, one huge advantage that the present invention has, being a reciprocating rod pump system, over other continuous pumping systems, and even over the DAP of U.S. Pat. No. 5,497,832, is that there is no fluid production on the downstroke. This means that for half of the operating time there is little or no relative velocity anywhere in the wellbore. During this static "dead time", droplet conflation and upward oil droplet movement under the force of gravity is at a maximum for the fluids in question.

Figure 2:
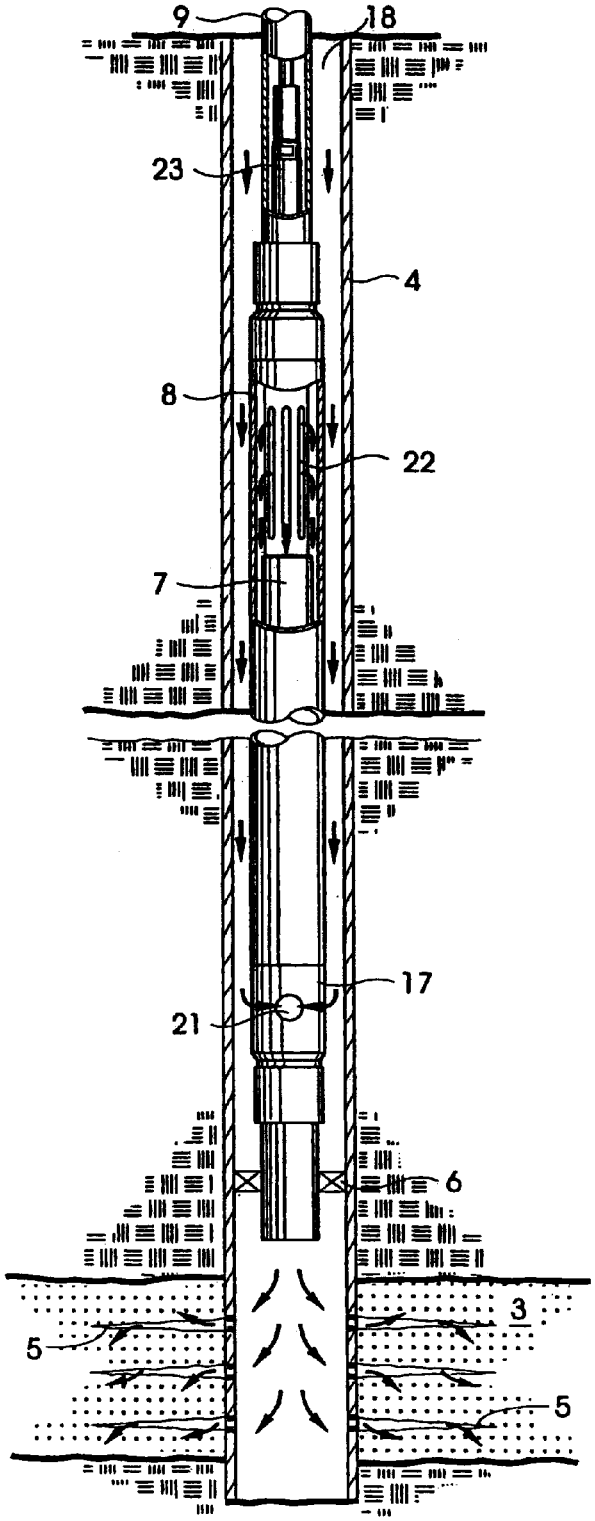
FIG. 2 is a side elevation view, partially in section, of the bottom tubing pump/outer housing and the water disposal side of the dual pump gravity separation system of the present invention.

Referring to FIG. 2, after the water passes down through the annular area 18 between the casing 4 and lower production tubing 9 it is drawn down past the outer housing 8 and into the intake 21 to the bottom tubing pump 7 through the bottom intake/discharge adapter 17. Discharge from the bottom tubing pump is through a slotted discharge connector 22. Discharge fluid flow is directed back down through the intake/discharge adapter 17 and injected into a disposal zone 3, below a production packer 6, disposed immediately above the disposal zone 3. The pump is connected to the actuating sucker rod string above it by a rod on/off tool 23 in conventional manner. Tensile rod loading is on the upstroke only in traditional fashion.

Figure 3:
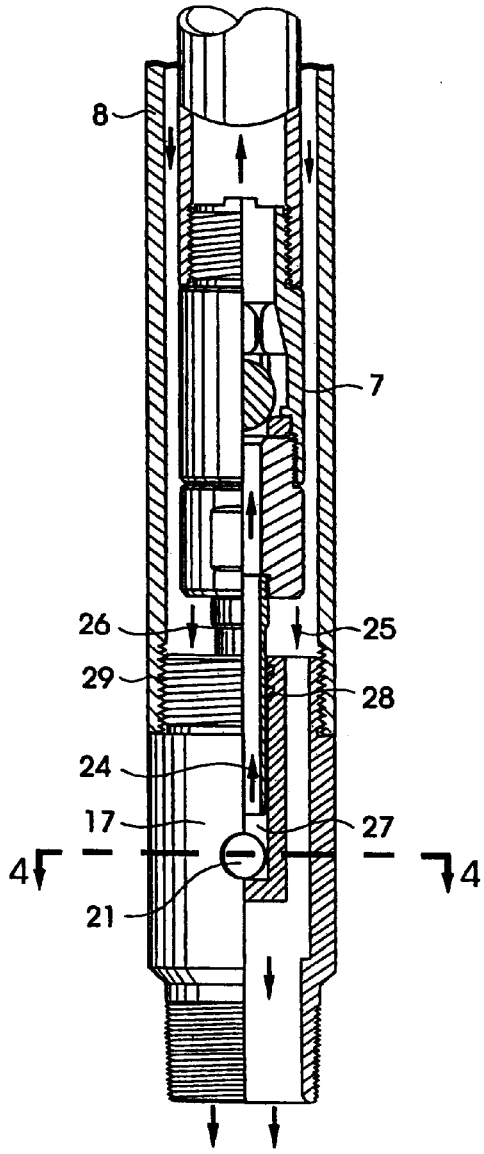
FIG. 3 is a side elevation view, partially in section, of the bottom intake/discharge adapter and the bottom portion of the bottom tubing pump of the dual pump gravity separation system of the present invention.
Figure 4:
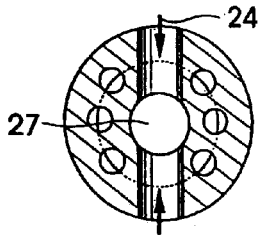
FIG. 4 is a sectional plan view of the bottom intake/discharge adapter taken along line 4–4 of FIG. 3.

FIG. 3 and FIG. 4 depict a cross-section and plan view of the bottom intake/discharge adapter 17. The bottom intake/discharge adapter 17 facilitates fluid flow 24 into a conventional tubing pump 7 while allowing for the discharge product 25 of said pump to be simultaneously passed by the intake 21 and on to a lower disposal zone 3. The bottom of the conventional tubing pump 7 is fashioned with a stinger 26 to facilitate intake to the pump. The stinger 26 fits within a vertical cavity 27 fashioned into the bottom intake/discharge adapter 17. A seal 28 is effected between the stinger 26 and the cavity 27 in the bottom intake/discharge adapter 17, effectively isolating the intake fluid 24 from the discharge fluid 25. The bottom intake/discharge adapter 17 is attached to the inside diameter of the outer housing 8 by a threaded connection 29.

Figure 5:
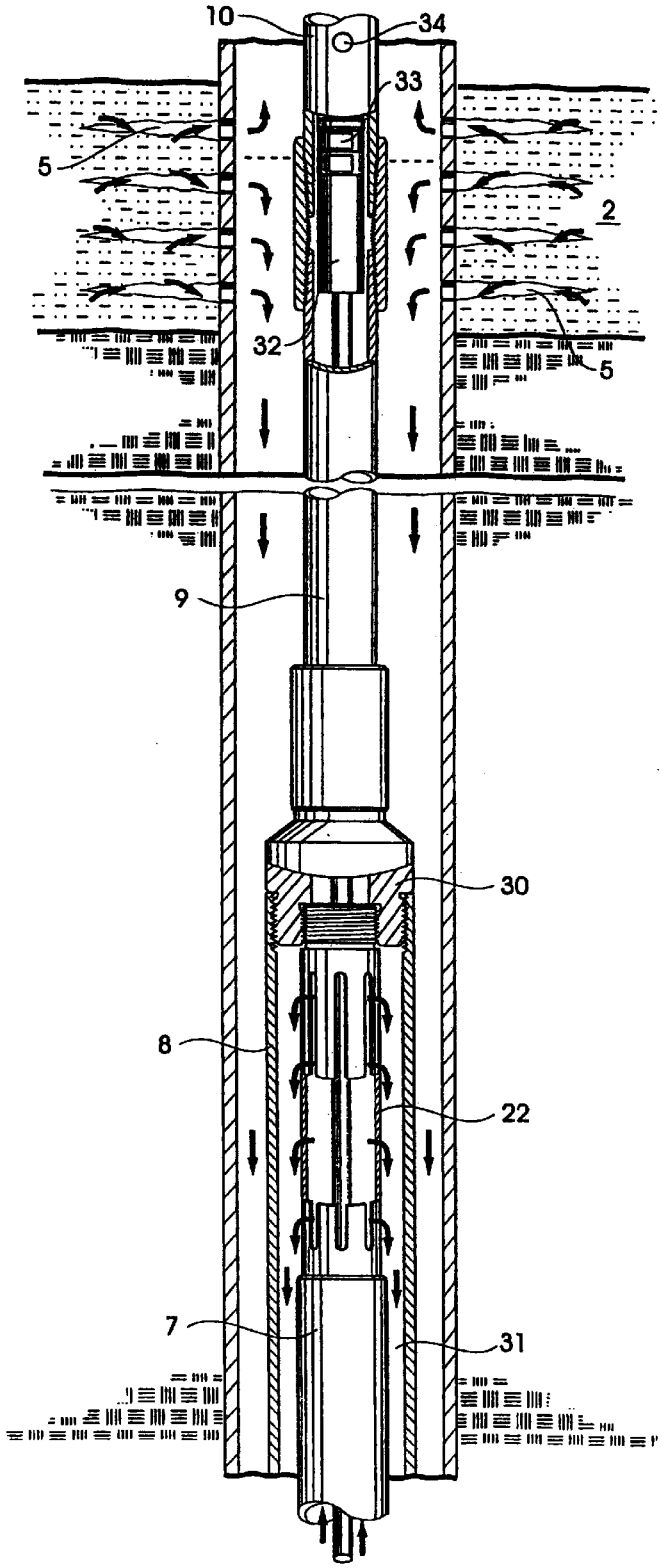
FIG. 5 is a side elevation view, partially in section, of the top portion of the bottom tubing pump of the dual pump gravity separation system of the present invention.

Referring to FIG. 5, the bottom tubing pump 7 discharges through the slotted discharge connector 22.

The slotted discharge connector 22 is attached at its bottom to the top of the bottom tubing pump 7 and at its top, to the top housing connector 30. Further, the top housing connector 30 is attached at its bottom to the outer housing 8 and at its top to the bottom production tubing 9. This effectively suspends and centralizes the bottom tubing pump 7 and effects a mechanical connection of all components to the production tubing above 9 while still facilitating fluid discharge from the bottom tubing pump 7. Fluid discharged through the slotted discharge connector 22 flows down around the outside of the conventional bottom tubing pump 7 in the annulus 31 created between the inside diameter of the outer housing 8 and the outside diameter of the pump 7. Fluid is present inside the lower production tubing 9 but it is not able to travel upward as the rod seal unit 32 and the dual hold-down 33 seated in the cross-drilled nipple 10 effect a hydraulic seal between the discharge of the bottom tubing pump 7 and the intake holes 34 of the top insert pump.

FIG. 6 depicts the components that facilitate fluid intake holes to the top insert pump 12 and hydraulic isolation between the bottom tubing pump water discharge stream and the top pump oil rich stream 15. As before, production fluid 14 enters the wellbore 1 and oil rich fluid 15 above the zero velocity area 20 moves upward to the intake 34 of the top insert pump 12. The intake 34 for the top insert pump 12 actually starts with the cross-drilled seating nipple 10. The cross-drilled seating nipple 10 is longer than a standard rod insert pump seating nipple. Intake holes 34 are effected approximately half way along the length of the nipple to facilitate fluid flow 15 to the top insert pump 12. The inside diameter of the seating nipple is a smooth bore to facilitate hold-down sealing in traditional manner above and below the cross-drilled holes. Inside the nipple is seated a "dual hold-down" 33. The top half of the hold-down 35 is a conventional API (American Petroleum Institute) hold-down which provides hydraulic isolation between the intake flow to the top insert pump 12 and the discharge fluid in the production tubing above in traditional manner. Below the top half of the hold-down 35 is found a hollow tube 36 with holes effected in it. This hollow tube 36 allows for the connecting seal rod 37 between the top and bottom pumps and the holes allow for flow into the top insert pump 12. Immediately below the hollow tube 36 is a second hold-down 38. This lower hold-down 38 is again configured as a standard API hold-down, only slightly modified to attach to the hollow tube 36 above and the rod seal unit 32 below. The rod seal unit 32 effects a hydraulic seal around the connecting seal rod 37 between the two pumps. The rod seal unit 32 and the lower hold-down 38, together effect hydraulic isolation between the discharge of the lower tubing pump inside the lower production tubing 9 and the intake flow 15 of the top insert pump 12 through the cross-drilled seating nipple 10 and the hollow tube 36.

Figure 7:
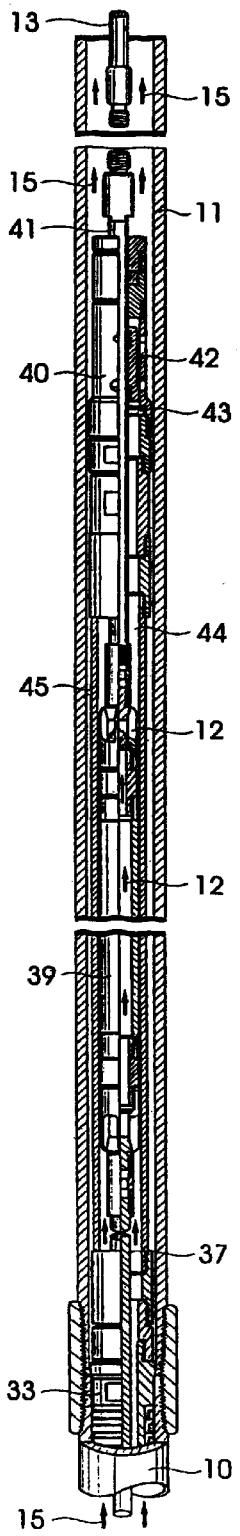
FIG. 7 is a side elevation view, partially in section, of the top insert pump of the dual pump gravity separation system of the present invention.

FIG. 7 depicts the top insert rod pump 12. This pump 12 is run on sucker rods 13 inside of the production tubing 11 and is seated into the cross-drilled seating nipple 10 in traditional fashion. Fluid intake 15 to the pump is through the cross-drilled seating nipple 10 and dual hold-down 33 as before. People skilled in the art will note that there is no conventional standing valve present. It can be seen that a connecting seal rod 37 extends down from the bottom of the plunger 39. As before, this connecting seal rod 37 runs down through the dual hold-down 33 and rod seal unit to effect a connection with the plunger of the bottom tubing pump such that both pumps are stroked by the same sucker rod string 13. The top insert pump of the current invention utilizes a ring-type standing valve 40 at the top of the pump. A conventional reciprocating sucker rod pump valve rod 41 runs through a drop 42 in the ring valve 40 effecting a hydraulic seal between the valve rod 41 and the drop 42. On the downstroke, when a conventional rod pump standing valve would be closed, the drop 42 seats on a seat 43, effecting a hydraulic seal between the cavity 44 inside the barrel 45 of the pump, and the production fluid 15 inside the production tubing 11 above. On the upstroke, fluid displacement lifts the drop 42 and fluid is displaced into the production tubing 11 in traditional manner.

It should be noted that the current invention could easily be adapted to uphole disposal. Also, it may be possible to configure the bottom tubing pump to utilize a central hollow tube to both stroke the pump and dispose of water, thereby eliminating the outer housing and decreasing overall system size.

The principles, preferred embodiment and mode of operation of the present invention have been described in the foregoing specification. In view of this disclosure, it may become apparent to a person skilled in the art that various changes may be made thereto without departing from the spirit and scope of the invention or sacrificing all of its material advantages, the form hereinbefore described being merely preferred or exemplary embodiment thereof.

What is claimed is:

1. A system to be installed into a subterranean hydrocarbon producing wellbore, to lift an oil rich stream of fluid to a ground surface while disposing of a large proportion of water, comprising:

a. a casing string in the hydrocarbon producing wellbore extending downwardly through a hydrocarbon producing formation and a water absorbing formation;

b. perforations into each of the hydrocarbon producing formation and the water absorbing formation;

c. at least one production packer disposed immediately adjacent the water absorbing formation;

d. a string of production tubing extending down to the hydrocarbon producing formation;

e. a reciprocating sucker rod pumping system consisting of a top insert rod pump to lift an oil rich stream to the ground surface, said top insert rod pump having an intake for oil rich production fluid to enter the pump when said pump is on an upstroke, a bottom tubing pump to dispose of a large proportion of water to the water absorbing formation when said pump is on the upstroke, a dual hold-down to hold the pump in the production tubing and to hydraulically isolate different production streams from each other a connecting rod seal unit to hydraulically isolate the water production of the bottom tubing pump from the oil rich production of said top insert pump, a ring valve coupled to the top of said top insert pump to isolate production fluid in the production tubing from said pump when said pump is on a downstroke, intakes to each of the two pumps separated by a distance, facilitating oil/water gravity separation of produced hydrocarbon fluids in the wellbore before the produced hydrocarbon fluids separately reach said intakes, and at least one connecting rod coupling said two pumps; and f. a sucker rod string to actuate the reciprocating sucker rod pumping system.

2. The system according to claim 1 wherein the intake also acts as a seating nipple and consists of:

a. a longer than standard seating nipple;

b. a smooth seal bore on said nipple, and c. cross-drilled holes at midpoint of said nipple to facilitate fluid flow into the top insert rod pump.

3. The system according to claim 1 wherein the dual hold-down consists of:

a. a hold-down coupled to the bottom of said top insert pump;

b. a perforated tube coupled to said hold-down that allows the connecting rod to actuate the bottom tubing pump of and provides for direct fluid intake to said top insert pump;

c. another hold-down modified in such a way as to be coupled to said perforated tube above it and the said connecting rod seal unit; and d. the said connecting rod seal unit effects a seal around the connecting rod and isolates the water production of the bottom tubing pump from the oil rich production of said top insert pump.

4. The system according to claim 1 wherein the bottom tubing pump maintains sucker rod loading on an upstroke and a downstroke and consists of:

a. a bottom intake/discharge adapter which facilitates water intake into said bottom tubing pump while allowing for the discharge product of said pump to be simultaneously passed by said intake and disposed into the water absorbing formation on the upstroke;

b. a slotted discharge connector coupled to the top of said bottom tubing pump;

c. an outer housing that fits around said bottom tubing pump and allows discharged water from said slotted discharge connector to be directed down past the outside of said bottom tubing pump and through said bottom intake/discharge adapter and disposed into the water absorbing formation on the upstroke; and d. a rod on/off tool that couples the plunger of said bottom tubing pump to the connecting rod and the plunger of the top insert rod pump such that the plungers of both pumps can be actuated by the same sucker rod string.

5. A method of lifting an oil rich stream of fluid from a subterranean hydrocarbon producing wellbore to a ground surface while disposing of a large proportion of water in said wellbore comprising:

a. running a casing string through a hydrocarbon producing formation and through a water absorbing formation;

b. perforating the casing string into each of the hydrocarbon producing formation and the water absorbing formation;

c. setting at least one production packer immediately adjacent the water absorbing formation;

d. assembling and running a string of production tubing down to the hydrocarbon producing formation and the water absorbing formation;

e. assembling a reciprocating sucker rod pumping system consisting of a top insert rod pump to lift an oil rich stream to the ground surface, said top insert rod pump having an intake for oil rich production fluid to enter the pump when said pump is on an upstroke, a bottom tubing pump to dispose of a large proportion of water to the water absorbing formation when said pump is on the upstroke, a dual hold-down to hold the pump in the production tubing and to hydraulically isolate different production streams from each other, a connecting rod seal unit to hydraulically isolate the water production of the bottom tubing pump from the oil rich production of said top insert pump, a ring valve coupled to the top of said top insert pump to isolate production fluid in the production tubing from said pump when said pump is on a downstroke, intakes to each of the two pumps separated by a distance, facilitating oil/water gravity separation of produced hydrocarbon fluids in the wellbore before the produced hydrocarbon fluids separately reach said intakes, and at least one connecting rod coupling said two pumps; and f. operating the reciprocating sucker rod pumping system with a sucker rod string to lift an oil rich stream to surface and to dispose of a large proportion of water to the water absorbing formation.

* * * * *